United States Patent [19]

Thiel et al.

[11] 4,085,517

[45] Apr. 25, 1978

[54] ARTICLE TREATMENT APPARATUS

[75] Inventors: Alfons W. Thiel, Mainz; Hans Martini; Peter Wolf, both of Wiesbaden; Albert Runkel, Mainz, all of Germany

[73] Assignee: Bellaplast GmbH, Wiesbaden, Germany

[21] Appl. No.: 716,565

[22] Filed: Aug. 23, 1976

[51] Int. Cl.[2] ..... F26B 25/00

[52] U.S. Cl. ..... 34/21; 34/105; 34/216; 34/236; 302/2 R

[58] Field of Search ..... 34/21, 10, 104, 210, 34/105, 216, 217, 236; 302/2 R, 24, 29, 31

[56] References Cited

U.S. PATENT DOCUMENTS

| | | | |
|---|---|---|---|
| 3,537,187 | 11/1970 | Cvacho et al. | 34/21 |
| 3,539,222 | 11/1970 | Hollenton et al. | 302/2 R |
| 3,685,632 | 8/1972 | Brady | 302/31 |
| 3,775,862 | 12/1973 | Emge | 34/105 |
| 3,840,999 | 10/1974 | Whelan | 34/105 |

*Primary Examiner*—Kenneth W. Sprague
*Assistant Examiner*—James C. Yeung
*Attorney, Agent, or Firm*—Strauch, Nolan, Neale, Nies & Kurz

[57] ABSTRACT

Cup-shaped articles made of thermoplastic material which have their outer surfaces printed or coated with a heat-sensitive material are dried in apparatus wherein a feeding device conveys the printed or coated articles to the lower end of a vertical run of an endless belt in a drying device, so that the articles are placed in inverted position on the belt to be held on the belt by suction exerted through the belt, the articles being so handled in the feeding device that they enter the drying device in proper orientation and in alignment with and at the same speed as the belt. The feeding device may be an arcuate channel with pneumatic pressure advance of the articles, or may be a porous belt running over a suction chamber.

23 Claims, 12 Drawing Figures

Fig. 7
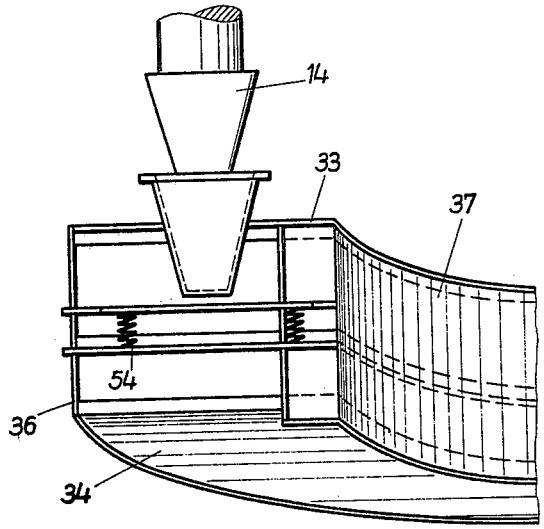
Fig. 8
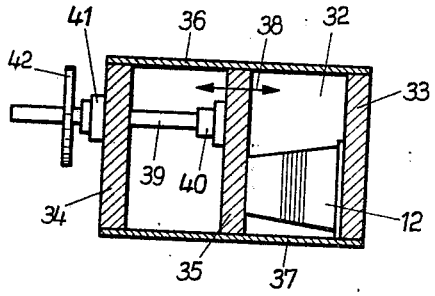
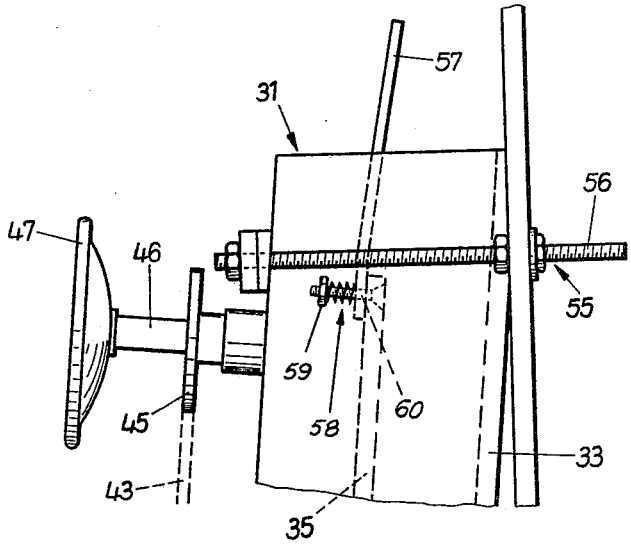
Fig. 9

ARTICLE TREATMENT APPARATUS

This invention relates to apparatus for the treatment, especially drying, of cup-shaped articles that have been coated or printed with a heat-sensitive material, especially thin-walled articles of thermoplastic synthetic material, by passing the articles on a suitable transport arrangement past heat treatment devices. The transport arrangement may preferably comprise an endless belt system arranged essentially vertically in a closed tunnel system containing the heat treatment devices and associated suction means holding the articles on the belt or belts and for the evacuation of media, for example, vapors, gases, or the like, used and/or developed in the treatment of the articles. Apparatus of this type are disclosed in German Offenlegungsschrift No. 23, 35, 910 published Jan. 30, 1975, and in German Offenlegungsschrift No. 24, 27, 448 published Dec. 12, 1975.

It is proposed in said DT-OS 23, 35, 910 and DT-OS 24, 27, 448 to discharge the articles from a treatment machine, for example a printing machine, directly bottoms down onto continuously running endless belt means of the treatment apparatus, using compressed air or other means. However, it can not be assured in this manner that the articles attach to the endless belt means at equal distances and in desired lateral arrangement, or are adequately held on the endless belt means. Rather, with this type of loading, the articles may either not be held adequately on the endless belt means and thus drop away, or they are held on the endless belt in an oblique, unsuitable position.

The present invention relates to the substantial development and improvement of such apparatus with respect to the rapid, secure and accurate oriented transfer and attachment of the articles to endless belt or belts and the secure holding of the articles in position while being transported past the heat treatment devices. The term heat treatment as used herein includes radiation in the infrared and ultraviolet regions. For this purpose, several problems for attaining the desired, accurate and secure attachment of the articles on the continuously running and vertically arranged endless belt means had to be solved.

It is therefore a main object of the invention to provide a drying apparatus, for drying articles having had a previous surface treatment such as printing, in which such articles are transferred by a feeding device to a vertically running transporting means such as endless belt means, transfer being such that the articles being fed approach the transporting means of the drier in a movement substantially co-directional with the movement of that transporting means. Thereby shock or abrupt movement is avoided when the articles are taken over by the transporting means of the drier. Preferably the transporting means includes endless transporting belt means, and it is a further more specific object of the invention to provide a secure and efficient related speed transfer and attachment of the articles to be dried onto continuously moving endless belt means.

It is a further object of the invention to provide that the articles to be dried are taken over by the endless belt or other transporting means of the drying device in an optimum condition for drying.

Another object of the invention is to provide a novel feeding device wherein a succession of articles having been pretreated as by printing are transferred in predetermined orientation to enter the lower end of a vertically moving endless belt means or like transport for carrying the articles through a treatment tunnel.

A particular object of the invention is to provide a novel drying apparatus for thin-walled articles having a bottom part and a circumferential wall part ending at a circumferentially open top rim, for example thin-walled cups or the like, such articles having been treated as by printing on the outer surface of the circumferential wall, wherein the articles are transferred in inverted condition onto transporting means of the drier, such as one or more endless belts, so that the open rim of each article is held in contact with the said transporting means.

It is a further important object of the invention to combine a novel feeding device with the transport of the drier device, for the efficient rapid feeding in of the articles with accurately oriented movement in the article carrying direction of the endless belt. In this manner, a considerably greater amount of treatment time than was hitherto available is provided for the articles on the endless belt means, whereby the operating speed of the endless belt means and the drier can be increased in comparison with earlier apparatus. Moreover, it is assured that each article is brought into accurately predetermined lateral position on the endless belt means and into secure connection with the endless belt means, and particularly into secure cooperation with suction holding devices of the endless belt means.

In a preferred embodiment, the novel feeding device is essentially configured as a channel which guides the articles being fed to the drying device essentially into movement in the direction of motion of the endless belt, the articles being preferably pneumatically transported and positioned in the lateral direction. In this channel, the feeding motion of the articles is stabilized and they are deflected to move out of the channel approximately parallel to the direction of motion of the endless belt means. The width of the channel is preferably adjustable to suit the height of the articles. By such adjustment of the channel width to provide only little clearance with respect to the height of the moving articles, the articles are forced to maintain the desired accurate orientation and lateral position through the channel, so that jamming of the articles, as well as contact between the channel and the printed and still moist outer surfaces of the cup or like article, is avoided. The foregoing novel features are provided as specific objects of the invention.

When the feeding device follows a pretreatment apparatus, for example a printing machine, from which the articles are ejected axially from a carrier, it is an object of the invention to arrange resiliently urged impact and buffer plate at the inlet of the feeding device for controllably intercepting the articles. In this manner, the relatively rapid motion of the articles entering into the feeding device is effectively intercepted and buffered, so that the articles can be fed to and into the drier in stabilized motion.

The endless belt means of the drying device in accordance with the preferred embodiment of the invention is arranged vertically with respect to the outlet of the feeding device, and so that channel of the feeding device is preferably arranged to extend in an arc from an upwardly facing inlet into which the articles fall downwardly and then upwardly toward the bottom inlet of the drying device. In this manner, free fall of the articles can be utilized for introduction into the feeding device.

It is within the scope of the invention, to provide a resiliently urged braking and pressure plate for the articles at the end of the channel which is located at the feeding point or inlet to the drying device. At this inlet the articles are pressed against the endless belt means by suction holding and association with this plate so that they attain a secure engagement and position on the endless belt means.

In another embodiment of the invention, the feeding device can be a transfer device which holds the articles by suction on a carrier element and feeds them through an arcuate path to the endless belt. In this embodiment, the carrier element can be a porous endless belt which runs over a suction chamber. This porous endless belt may hold the articles temporarily by suction, and then release them when they are taken over by the endless belt means of the drying device.

For the treatment of containers which are open at the top for example cups or beakers, it is an object of the invention to relate the holding devices of the endless belt and feeding devices for feeding the containers to the endless belt means of the drier in such a manner that the containers are applied and held on the belt means with their openings contacting the belt or belts. By such inverted mounting of the containers on the endless belt, a particularly secure seating of these containers on the endless belt means is assured. The negative pressure of the suction means occupies the interior of the articles, which are thereby held with the opening edges pressed against the belt means. Even when the action of this suction may be interrupted for a short time, the container may still continue to be held to the endless belt means by residual suction.

The invention offers special advantages in apparatus in which the articles which are to be treated are fed past treatment devices, for example radiation heating elements, at a desired accurate distance. Because the feeding device in accordance with the invention, as explained above, is especially suitable for the positioning of the articles in an exact location and with special security on the endless belt means, it suffices, for the precision and security of the desired treatment of the articles, if the treatment devices, for example radiation heating elements, are arranged along at least one side wall of the tunnel. With the use of radiation heating elements as the treatment devices, a further improvement in equalization of treatment can be attained by configuring as reflectors those portions of the tunnel side walls and cover which are not occupied by radiation heating elements. To increase the operating safety, especially since no special alignment and safety measures are required during the feeding of the articles on the endless belt, it is recommended to configure one of the side walls of the tunnel with a side hinge in order to provide free access to the inside of the tunnel at any time. These features may be regarded as further specific objects of the invention.

Further objects of the invention will appear in connection with the appended claims and the annexed drawings.

BRIEF DESCRIPTION OF DRAWINGS

FIG. 7 is an enlarged fragmentary view in section showing the inlet of the feeding channel of FIG. 6;

FIG. 8 is a section substantially on line VIII—VIII of FIG. 6;

FIG. 9 is a partial side view of the outlet side of the feeding channel of FIG. 3;

PREFERRED EMBODIMENTS

Figure 1:
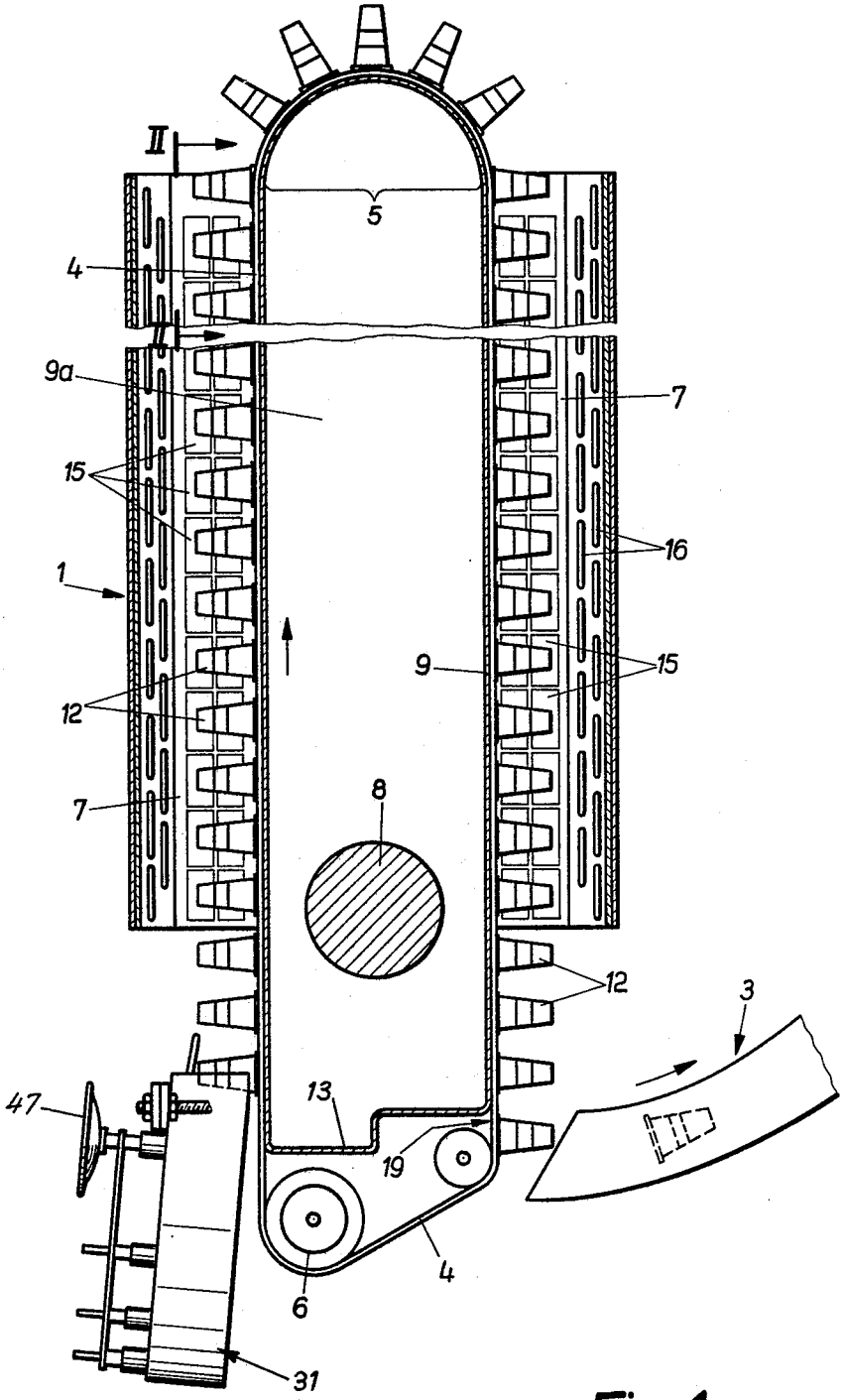
FIG. 1 is a schematic side view showing a drying apparatus in accord with one embodiment of the invention, with one side wall removed.

The drying device 1 shown in FIG. 1 is arranged between a printing machine 2 (FIG. 3) and a removal device 3. An endless belt 4 runs on the side of the drying device 1 nearest to machine 2 from a pick-up point or inlet vertically upwards to an arcuate dome 5 where it turns through 180° and runs from dome 5 vertically down to the delivery point or outlet at device 3. As shown the pick-up point and the delivery point lie at about the same height at the lower end of the drying device 1. Below the pick-up and delivery points, belt 4 is guided over a deflecting roller and a drive roller 6.

Equally well two coaxial deflecting rollers with a central slot left open axially between them could be arranged at the top deflection point of the continuous belt 4 in place of the dome 5.

The belt 4 runs in the drying apparatus 1 inside parallel tunnels. Each of these tunnels is formed from two hinged, angle-profiled side walls 7 which overlap in the roof area and inside which the belt 4 runs, so that at each side an open ended enclosed vertical tunnel is formed with the delivery belt 4 and belt support bed 9. Interiorly of the bed 9 a suction chamber 9*a* is formed with solid side walls, to which an evacuation tube 8 is connected through one of the side walls. The evacuation tube 8 leads to devices (not shown) for evacuating and rendering harmless the vapours arising from or released during the drying process.

Figure 2:
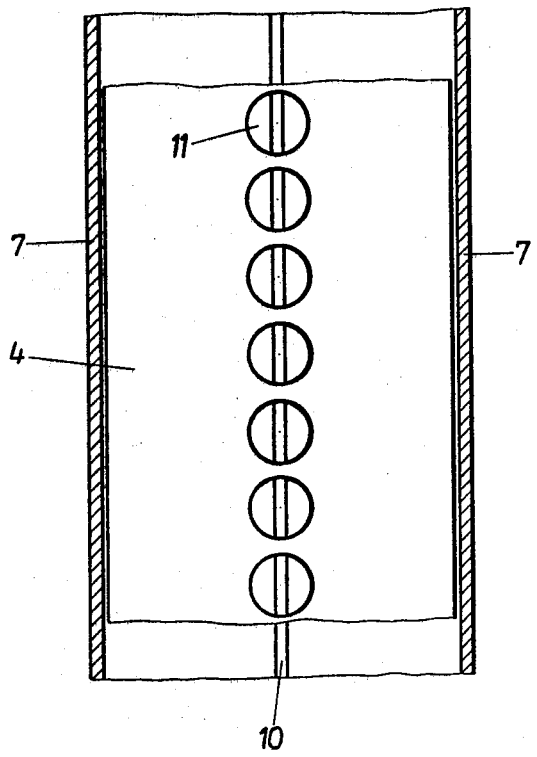
FIG. 2 is an enlarged section substantially on line II—II of FIG. 1.

As can be seen from FIG. 2, the bed 9 is formed with a through slot 10 while in the central region of the belt 4 there is a row of holes 11 running over slot 10. The diameter of holes 11 is considerably less than that of the article 12 which is placed on belt 4. In addition, the distance between the holes 11 is established so that at least two holes 11 open into the belt surface occupied by the article. In this way the slot 10 and the holes 11 form a suitable holding device for the articles and at the same time the holes between spaced articles provide a completely effective suction device for the vapours arising or being released in the tunnel, and for the treatment medium introduced into the tunnel, which is dry air in this embodiment.

As shown in FIG. 1, articles 12, which are cup-shaped or beaker-shaped in this example, are placed on belt 4 with their open ends down, so that positive suction exerted through holes 11 holds them on the continuous belt, even in the region of the arc-shaped path of the belt 4 over dome 5. The drying of the articles is carried out here by the combined effect of infrared radiators 15 arranged on the inner side of the side walls 7 and the air drawn in through slots 16 located in the angle areas of the side walls and the tunnel ends and evacuated through holes 11, the slot 10, the evacuation chamber 9*a* and suction tube 8.

Picking up of the articles and feeding them to the drying device is preferably carried out by means of the feeding device 31 shown in FIGS. 3 to 9 in detail, although equivalent devices which make possible the placing of the articles on the continuous belt 4 with their open end down may also be considered. The removal device 3 connected to the take-off point of the drying device is pneumatic and may be of a known type. It may be constructed to remove the treated articles at the take-off point by suction.

The suction chamber 9*a* is formed with substantially solid side walls and belt bed 9 is closed at the bottom by a sealing wall 13. This sealing wall 13 extends up to below the drier pick-up point but on the other hand lies above the drier discharge point. Slot 10 extends from the pick-up point all the way around the bed to terminate just above the discharge point. Thus, the slot 10 in the belt bed 9 and the holes 11 in the belt 4 are effective at the pick-up point as holding devices for the articles 12, but not at the delivery point. If desired, a compressed air nozzle can be arranged at the delivery point behind the belt 4 which, as shown by the arrow 19, is effective through the belt 4 by way of the holes 11 for blowing the articles off the belt onto the device 3.

Operation of the foregoing drying apparatus is as follows:

When the exhaust system is connected, evacuation tube 8 is energized, and a partial vacuum forms in chamber 9*a*. This causes gaseous treatment medium, which is air in this embodiment, to be continuously sucked in from slots 16 and the tunnel through the slot 10 in the belt bed 9 and the holes 11 in the delivery belt 4. If an article 12 is now placed on belt 4 by the pick-up device, it is immediately held fast thereon by suction acting through slot 10 and holes 11. The forward speed of belt 4 driven by drive roller 6 is variable and adjusted to the time sequence of the arriving articles, so that continuous loading of belt 4 may be guaranteed, and between the individual articles 12 there are still sufficient holes 11 left free in the belt to maintain a continuous flow of air through the two tunnels.

Within the two tunnels the moving articles 12 on the belt are thus subjected to the combined effect of infrared radiation and the enveloping passage of air. As the air enters not only through the slots 16, but is also sucked in through the open tunnel ends, there is advantageously a turbulent type of air movement inside the tunnel. However, with the articles 12 firmly held down by suction with their open ends on belt 4, there is no danger of the articles 12 being lifted or thrown from their places on belt 4.

Due to the flow and turbulence of air in the tunnels, the heat produced on those surface areas of the articles 12 nearest to the infrared radiators 15 is effectively distributed by the air over the whole surface of the articles 12 to be dried. Thus, on the one hand, an effective, rapid drying of the entire surface of each article is achieved, and on the other hand there is no danger of local over-heating of those surfaces. In order to prevent the tunnel walls from being locally heated by the infrared radiation and thus causing heating effects on the articles which cannot be calculated or controlled, it is desirable that, where they are not covered by infrared radiators 15, the inner tunnel wall surfaces should be constructed to reflect heat. This provides for more uniform heat distribution. In addition, the constant flow of air in the tunnel will also prevent localized heating of the tunnel walls.

The feeding device 31 indicated in FIG. 1 and shown in FIGS. 3 to 9 is basically constructed as a channel 32 which leads from below to the pick-up point of the drying apparatus 1, and in which the articles 12 are transported pneumatically, lying in a crosswise direction and moving parallel to their length axes. As can be seen from FIGS. 3 and 4, this channel is formed mainly as an arc, so that the articles 12 are introduced from above on the inlet side into this channel, directed along a semi-circular path and brought up to the belt 4 from below, i.e. along the vertical travel path shown approxiamtely by the arrow 4*c* in FIGS. 3 and 4. The outlet of channel 32 is in alignment with belt 4 as will appear.

The channel 32 has a rear wall 33, a front wall 34, a dividing or intermediate wall 35 parallel to the front and rear walls, an arcuate top wall 36 and an arcuate base 37. The dividing wall 35 is formed essentially in an arc, as are rear wall 33 and front wall 34. Front wall 34 and rear wall 33 are firmly secured to base 37 and top wall 36. On the other hand, dividing wall 35 is adjustable in the direction of the double arrow 38 of FIG. 8 sliding parallel to rear wall 33 between base 37 and top wall 36. For this purpose (FIG. 8), on its side furthest from the operative channel 32 which is the space between the rear and dividing walls, dividing wall 35 bears a number of screw spindles 39 which are mounted rotatably at 40 on the dividing wall, but are axially immovable. On the outside of front wall 34, a nut 41 for each of these adjusting spindles 39 is fixed, so that by turning spindles 39 in one direction dividing wall 35 is brought nearer to the rear wall 33 and by turning the spindles on the other direction wall 35 is brought nearer to front wall 34. All the adjustment spindles 39 have the same thread. Each spindle 39 bears on its outer end a chain-wheel 42. As can be seen from FIG. 3, over all the chain-wheels 42 of the adjustment spindles 39 a drive chain 43 is fitted and tensioned by means of tensioning device 44. Drive chain wheel 45, on the axle 46 of which a manual adjustment wheel 47 is fitted, also meshes into drive chain 43. By turning this manual adjustment wheel 47 all the adjustment spindles 39 are thus turned in the same direction and by the same amount so that the parallel position of the dividing wall 35 in relation to the rear wall 33 is guaranteed at every adjusted location. For the pneumatic oriented feeding of articles 12 along the channel, dividing wall 35 is adjusted to approximately the height of the article so that there is little play remaining and tipping of the articles 12 inside the channel 32 is prevented.

Figure 4:
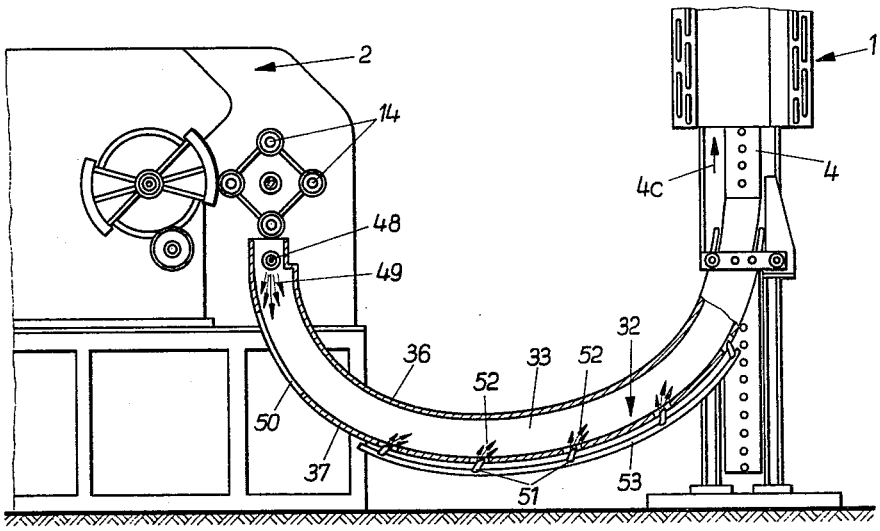
FIG. 4 shows the feeding device of FIG. 3, with parts broken away and in longitudinal section along the feeding channel.
Figure 5:
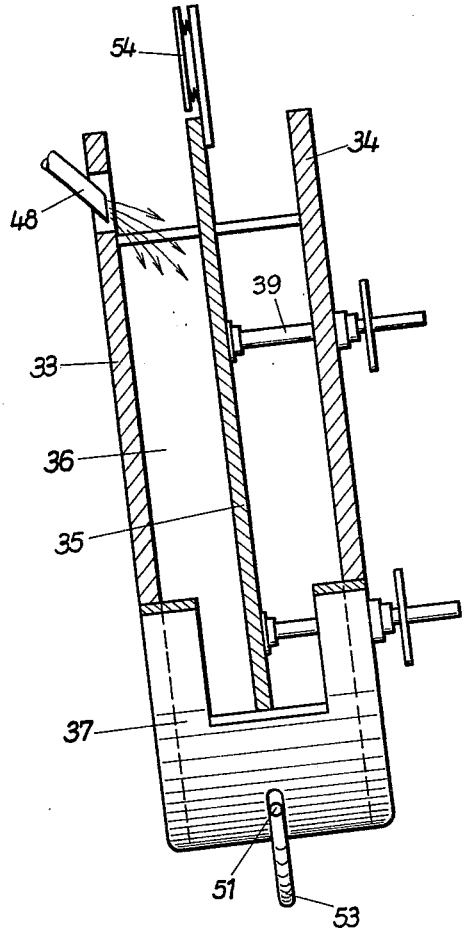
FIG. 5 is an enlarged section substantially on line V—V of FIG. 3.

At the entry point of the feeding device the article is axially displaced from carrier 14 and falls downward in free fall. The article enters channel 32 in free fall with its axis horizontal. Then the article 12 passes by a blowing nozzle 48 (FIGS. 4 and 5) which is arranged in rear wall 33 and points across and down into channel 32. The stream of air 49 emerging from nozzle 48 is directed, as shown in FIG. 4, more or less tangential to the delivery path of the articles and goes out through an opening 50 in base 37 smaller than an article. By the effect of this tangentially directed flow of air 49 the article initially free-falling, is guided positively along base 37, oriented as shown in FIG. 8, and the downward movement of the article is increased to such an extent that the centrifugal force effective on the article guides it over the remaining path through the arched channel 32. Further along the path of channel 32 blowing nozzles 51 (FIG. 4) are arranged, which blow into the interior of channel 32 through openings in base 37 streams of air 52 which are pointed more or less in the direction of the circumference, thus along the base 37. These blowing nozzles 51 are connected to a common compressed air inlet 53, and together with blowing nozzle 48 to a control device and air compression source (not shown).

At the entry to channel 32 of the feeding device there is a resiliently urged impact and buffer plate 54 which serves to intercept the articles from carrier 14, for example beakers, which are normally forced by the speed of fall past the rear wall 33 of the channel, and to damp out the movement of the articles 12 so that the articles enter channel 32 already stabilized.

Figure 3:
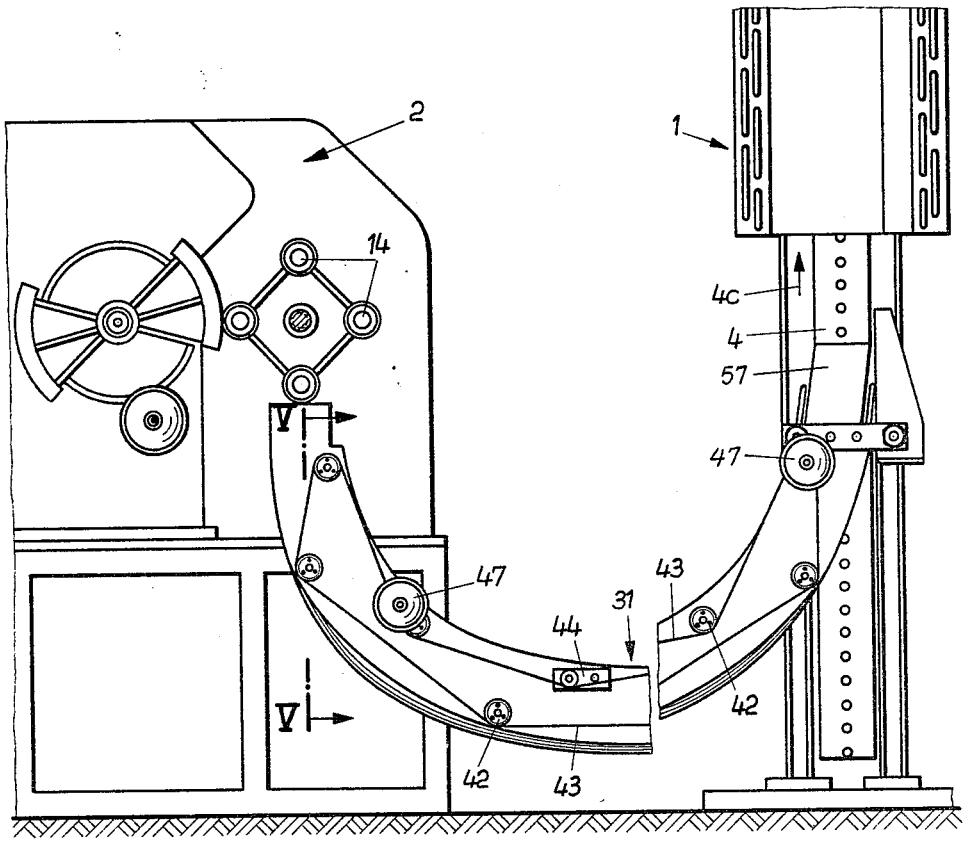
FIG. 3 is a somewhat schematic front view showing the feeding device for the articles which are to be dried into the drying apparatus.
Figure 6:
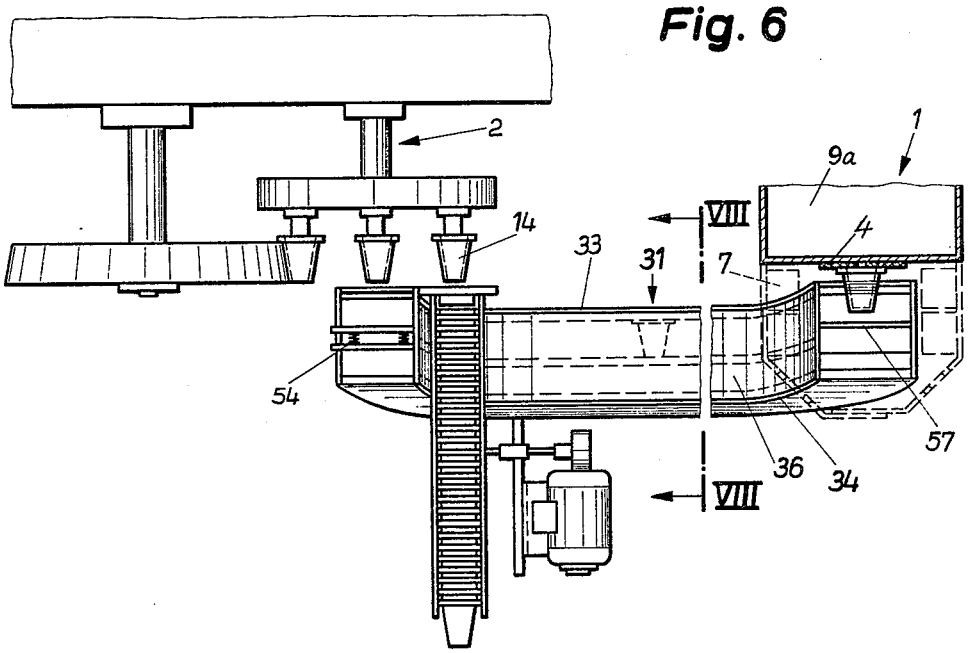
FIG. 6 is a plan view of the feeding device of FIG. 3.

As can be seen from FIGS. 3 and 9, the feeding device 31 is adjusted to fit tightly over belt 4 with a preferably suitably sloping end inclined relative to its base 37. For obtaining this fit adjustment member 55 is provided, fitted for example with adjusting screw spindles 56. For the secure feeding of each individual article 12 on to the endless belt 4, a resiliently urged inclined pressure and braking plate 57 is attached on the end of the dividing wall 35. This plate 57 presses the articles 12, arriving at high velocity in channel 32, against the endless belt 4 and thereby brakes each article 12 which is brought into contact with endless belt 4, to the speed of belt 4. For this purpose the resiliently urged pressure and braking plate 57 presses against the bottom of each article 12 emerging from channel 32 with a predetermined pressure or a pressure adjustable by spring 58 and the screws 59 of the mounting bolts 60.

As can be seen from FIGS. 3 and 4, the feeding device 31 is especially suitable for ensuring the picking up of articles forced away by compressed air axially from a carrier projection, for example from the moulding projection 14 of a printing machine 2 and for guiding them at regular intervals into the drying apparatus 1. In this way, damage to the article surface which has been treated, for example by printing, can be positively avoided. At the outlet of feeding device 31, in addition, appropriate adaptation of the transportation speed of the articles to the running speed of the endless belt 4 of the drying apparatus 1 reduces the risk of damage to the treated surface of the article.

Figure 10:
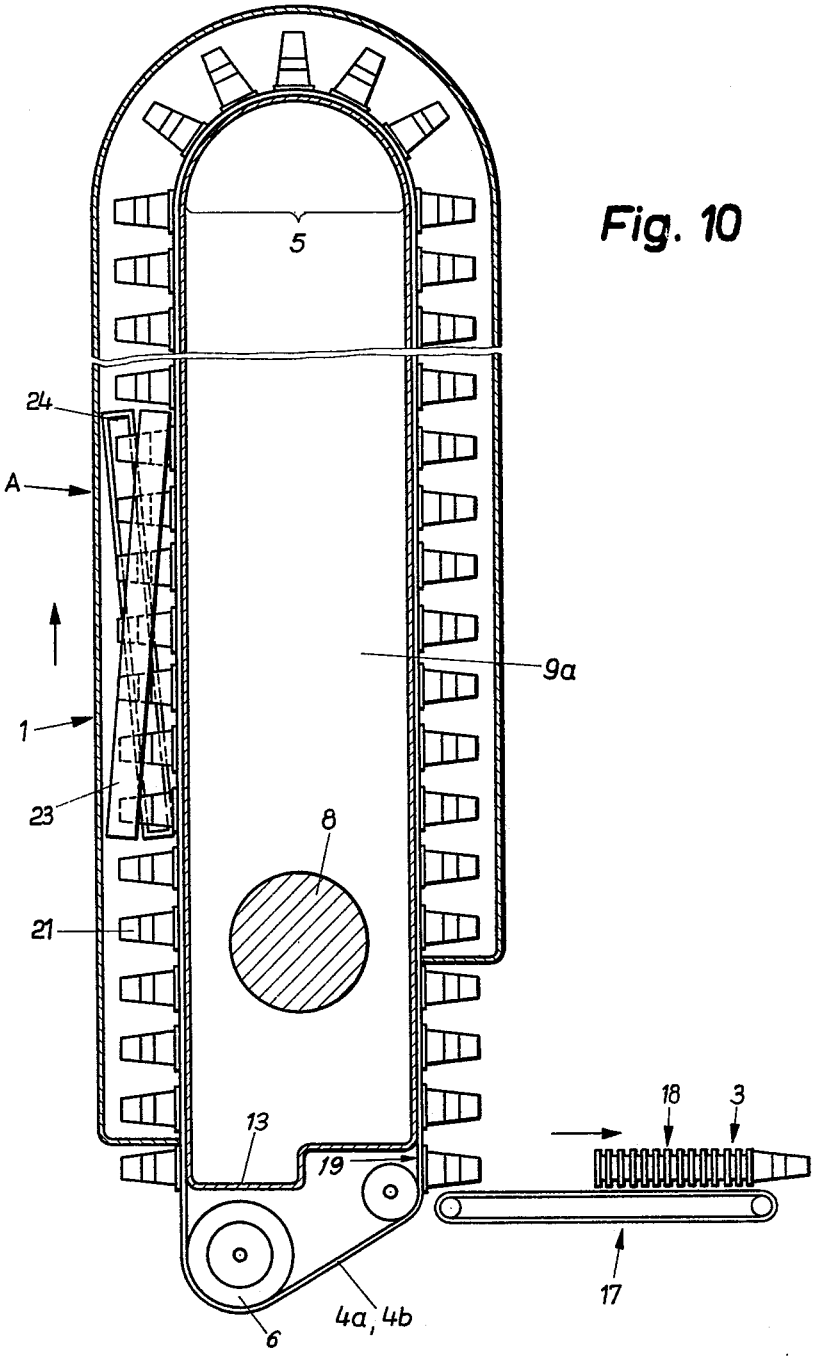
FIG. 10 is a schematic side view showing a further embodiment of the drying apparatus of the invention, with a side wall removed and the feeding device omitted.
Figure 11:
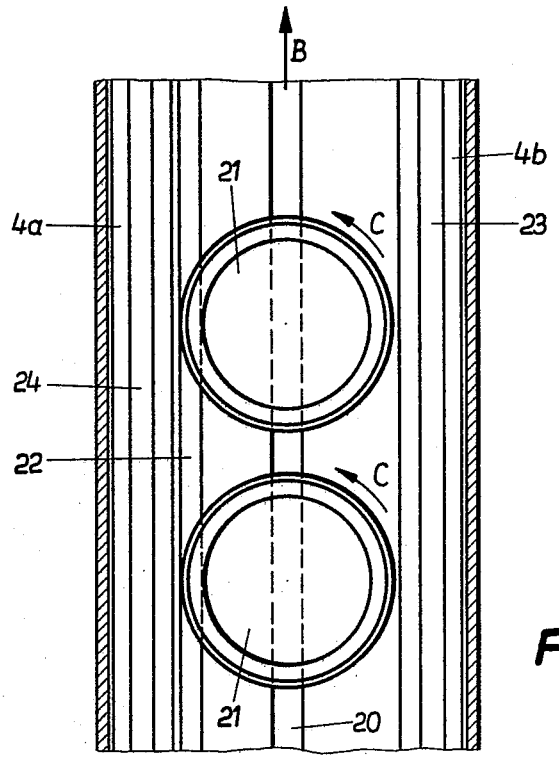
FIG. 11 is an enlarged partial view section showing the articles in position on the belt means of FIG. 10.
Figure 12:
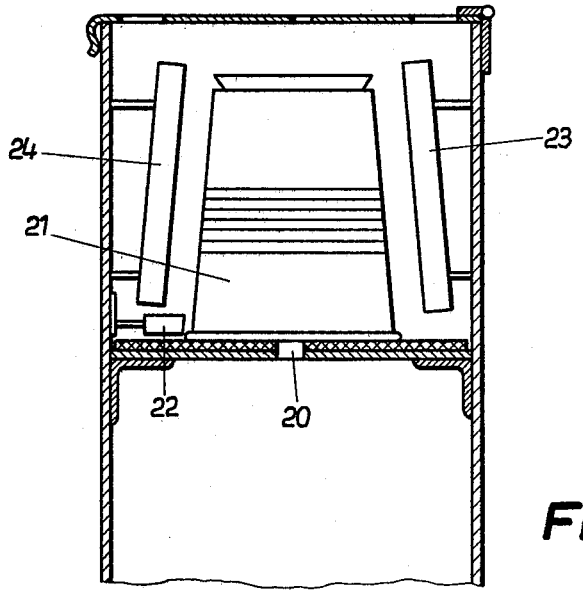
FIG. 12 is an enlarged partial view in section showing the treatment lamp in the dryer of FIG. 10.

In the embodiment of the drying apparatus shown in FIGS. 10 to 12 there are two parallel endless belts **4*a* and 4*b* situated adjacent to each other with a slot-shaped gap 20 between them and running vertically upwards through the tunnel at the side of the article pick-up point. At the dome 5 round which the two continuous belts 4*a* and 4*b*** turn through 180°, the tunnel is constructed in the form of an arch and runs continuously to the tunnel which continues to the delivery point.

The speeds of the two endless belts **4*a* and 4*b* are individually controlled. The slot-shaped gap provided between the two belts 4*a* and 4*b* serves also as the evacuation slot 20 for the downward suction onto the two belts of the open ends of the inverted articles 21, which are for example in the shape of beakers, by vacuum from the evacuation chamber 9*a***.

One drive roller as for belt **4*a* is indicated in FIG. 10. The other drive roller, separately powered for driving belt 4*b*** is coaxial.

The endless belts **4*a* and 4*b* are equipped with drives which may be controlled independently of each other, and may thus be independent of each other in the control of the forward movement imparted to the articles. By setting up different drive speeds for the belts 4*a* and 4*b*, the beaker-shaped articles 21 are each advanced along the belts with a simultaneous rotating and forward movement. Belt 4*a*, for example, may run backwards, but never faster than belt 4*b*. This ensures that the articles 21 are always pressed during the rotating and transporting movement against a fixed skirting board or guide rail 22**.

As can be seen from FIG. 10, two ultraviolet lamps 23, 24 are arranged opposite to one another on the side containing the pick-up point of the feeding device. Lamps 23, 24 extend the vertical height of an article 12 and are fixed diagonally displaced from one another. In this way, instead of the only limited effective beam-width of the ultraviolet lamp, the total height of the article is treated during the drying process. The oblique location required for the ultraviolet lamps can be determined from the maximum height of the articles 21. By using different speeds and sometimes also different movement directions of the two belts **4*a* and 4*b* individually tuned to each other, it is possible to establish a selected number of rotations of each article along the extent of lamps 23, 24** for example over a distance of one meter.

As soon as an article 21 is set up on the drier belts **4*a* and 4*b*, for example by means of feeding device 31 as in FIGS. 3 to 9 or a similar device, a firm holding suction occurs of this article at the evacuation slit 20. Immediately after being set down, the article 21 is also set in rotation by the different running speeds of the two drier belts 4*a* and 4*b*. During rotary movement the article 21, as FIG. 11 and 12 show, presses against the guide rail 22, so that the articles substantially roll along in contact with the guide rail 22 and are maintained at a constant distance from the heat lamps 23, 24. The lamps 23 and 24, between which the articles 21 are guided, may on one hand be adjusted to be substantially parallel to the inclination of the adjacent sides of the articles (see FIG. 12) and on the other hand set up obliquely in the lengthwise direction. The oblique positioning can be directly conformed to the maximum height of the actual article 21 and in addition it allows the full use of the limited effective beam width of the lamps 23 and 24**.

The speed of passing through or the number of revolutions of the articles in the drier is usually determined by the surface sensitivity of the material. By controlling independently the speeds for the two belts **4*a* and 4*b*, a selected relationship between them is possible. For example, if the belt 4*b* runs forward through the tunnel only very slowly with a simultaneously increased number of rotations (see FIG. 11**, arrow "B" denotes travel direction of the beakers, and arrow "C" denotes rotation of the beakers).

An increased forward movement of each article with a reduced number of rotations can be achieved if the belt **4*b* is moved forwards with the speed "X" (therefore in the direction of the arrow "B") and the belt 4*a* much more slowly, for example at half speed, moved backwards. The forward movement of the articles 21** can be still further increased and the number of rotations still more reduced if, for example, the belt 4b is run at speed "X" and the belt 4a is left stationary. A still further increase in the forward movement of the beakers can be reached if the belt 4b runs forwardly at speed "X" and the belt 4a is run forwards, for example, at approximately half-speed. Here, not only is the forward movement further increased, but also the number of rotations of the articles 21 is still further reduced. This adjustment can be varied until a very rapid forward movement of the articles 21 with only very slight rotating movement is achieved, for example, when belt 4b is run at speed "X" and belt 4a is run only slightly more slowly than belt 4b, also in a forward direction.

In the embodiment shown in FIGS. 10 to 12 the drying apparatus is equipped only on its pick-up side with ultraviolet lamps 23 and 24 which cross with their oblique arrangement on either side of the articles 21 to be treated. However, there are also other arrangements of such lamps which are equally possible, For example, there could also be ultraviolet lamps or infrared radiators arranged at the outlet side of the drying device 1. It would also be possible to provide the lamps only on one side of the article path. It is also conceivable that several ultraviolet lamps or pairs of ultraviolet lamps could be arranged behind one another along the path of the article through the tunnel.

Finally, in the embodiment shown in FIGS. 10 to 12, again a somewhat different device for taking off and delivering the dried articles is provided. After the end of the drying process, the beaker-shaped articles 21 held by suction on the delivery belts 4a and 4b are carried on downwards over a relatively short distance in the open air until they are relased just above a transportation belt 17 by the cessation of the suction effect at the slit between the continuous belts 4a and 4b due to the fact that the tunnel ends just above that point as shown in FIG. 10. In order to ensure the arrival of the treated beaker-shaped articles on the delivery belt 17, one or more compressed air nozzles can be arranged in the location 19 shown in the embodiment of FIG. 1, at the delivery point behind the slit between the continuous belts 4a and 4b. The beaker-shaped articles 21 taken off by the transportation belt 17 are carried together to a stack 18 and piled up until the desired number of articles for each stack 18 is reached. The completed stack 18 may then be taken on for further processing.

In both embodiments, the upward pointing part and the downward pointing part of the drying device are essentially the same, and the article pick-up point and discharge point are arranged at substantially the same height. However, this is not essential to the invention. On the contrary, the drying apparatus also offers the possibility of accommodating differences in height between the oulet of a previous treatment appliance, for example, a pressing or molding machine 2, and a device connected later, for example a sorting and packing device. It would also be conceivable to install the pressing machine on one floor and the packing device, and therefore the delivery device 3, on another, i.e. lower or higher floor of a building. If such a difference in height is sufficient for the length of the treatment section, the articles 12 or 21 can be removed before reaching the turning point of the continuous belt 4 or the continuous belts 4a and 4b.

Within the framework of the invention differently constructed types of devices for the transfer of the articles from a treatment machine, for example, a pressing machine, to the drying apparatus 1 can also be installed instead of the feeding device shown in FIGS. 3 to 9. For instance, such a feeding device can itself contain a driven article carrying element, for example a porous continuous belt which runs over an evacuation chamber and onto which the articles are held by suction. This carrying element can then travel over a semi-circular path to the continuous belt 4 or the continuous belts 4a and 4b of the drying device, in the manner of channel 32.

Preferably, in this case the carrying element of the pick-up device will travel at a distance corresponding to the height of the articles parallel to and in the same direction as the continuous belt 4 or 4a, 4b of the drying device, so that on transference to the continuous belt 4 or 4a, 4b of the drying device 1 the articles to be dried are already moving in the desired direction of travel and at approximately the desired travelling speed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for the heat treatment such as drying of cup-shaped articles that have had a surface treatment of heat-sensitive material, such as printing or coating, comprising a heat treatment device having tunnel means containing moving article transporting apertured belt means and associated suction means disposed for acting through said belt means for holding said articles in inverted position on said belt means to transport said articles in a predetermined direction between an inlet and an outlet of said tunnel means and means in the tunnel means for heat treating the moving articles, in combination with means for feeding a succession of said surface treated articles into said device at said inlet in such predetermined orientation that said articles are transferred to said belt means while moving laterally at substantially the same speed and in the same direction of movement as said belt means and enter said treatment device with their open ends facing said belt means.

2. Apparatus as defined in claim 1, said belt means comprising a continuously driven endless belt running within said tunnel means between said inlet and outlet and exteriorly of said tunnel means between said outlet and said inlet and having suction openings distributed along its entire length.

3. Apparatus as defined in claim 1, wherein said feeding device comprises means defining an arcuate open ended channel having its outlet end operatively connected to said heat treatment device, and means for moving articles along said channel toward said outlet end in such orientation as to enter said heat treatment device in alignment with the moving belt means.

4. Apparatus as defined in claim 3, wherein pneumatic means is provided for moving the articles along said channel.

5. Apparatus as defined in claim 3, wherein means is provided whereby said articles enter said channel in side-by-side relation and are moved laterally therealong to the outlet thereof.

6. Apparatus as defined in claim 3, wherein said channel has parallel longitudinal walls adjacent the top and bottom of each article moving therealong, and means is provided for adjusting the relative spacing between said walls to suit the height of the articles.

7. Apparatus as defined in claim 3, wherein said surface treated articles are mounted on a carrier from which they may be ejected fall down laterally, and said feeding channel is provided at its inlet end which is operatively located below said carrier with a resiliently urged impact and buffer member for intercepting the articles and directing them with lateral movement along the channel.

8. Apparatus as defined in claim 3, wherein said belt means run mainly vertically in said heat treatment device, particularly at the inlet and outlet ends, and said channel at said outlet end is disposed to move said articles vertically upward and into contact with said belt means at the inlet of said heat treatment device.

9. Apparatus as defined in claim 8, wherein said channel terminates at its outlet end in a resiliently urged pressure and braking member adapted to bias the emerging articles to engage their open ends with said belt means.

10. Apparatus as defined in claim 1, wherein said feeding device is a transport member upon which said articles are held by suction, said member extending in an arcuate path to said belt means at the inlet of said heat treatment device.

11. Apparatus as defined in claim 10, wherein said transport member is a porous belt connected to run over a suction chamber.

12. Apparatus as defined in claim 1, wherein suction means is provided for holding said articles on said belt means, and said tunnel means is formed with air inlet openings along its sides through which air is drawn to circulate about the surfaces being heated.

13. Apparatus as defined in claim 1, wherein said belt means comprises a pair of driven endless belts arranged side by side with a predetermined space between them to provide a suction aperture.

14. Apparatus as defined in claim 13, wherein said belts are driven continuously and means is provided for controlling the speed and/or direction of movement of one belt independently of the other belt.

15. Apparatus as defined in claim 1, including means for causing independent rotation of each article about its longitudinal axis which passing through said tunnel means.

16. Apparatus as defined in claim 1, wherein radiant heating members are disposed within said tunnel means and associated reflectors are disposed within the tunnel means for equalizing the heat treatment.

17. A method of drying generally cup-shaped articles which have had their external surfaces freshly printed or coated with a heat sensitive material which comprises the steps of placing a succession of said articles in longitudinally spaced relation along apertured endless belt means that transports the articles through a heat treatment tunnel having air admission openings, with said articles being inverted so that their open ends extend over at least some of the apertured region of the belt means in contact with said belt means but leaving some of said apertured region uncovered, and exerting suction through said apertured belt means to hold the articles on the belt means and at the same time drawing air through said openings into the tunnel and directing it along the article surfaces being heat treated before exhausting it through said belt means.

18. Apparatus for drying generally cup-shaped articles which have had their external surfaces freshly printed or coated with a heat sensitive material which comprises means defining a heat treatment tunnel having air admission openings, apertured endless belt means for transporting said articles through said tunnel, means for placing a succession of said articles in longitudinally spaced relation along said apertured endless belt means, with said articles being inverted so that their open ends contact said belt means and extend over at least some of the apertured region of the belt means while leaving some of said apertured region uncovered, and means for exerting suction through said apertured belt means to hold the articles in position on the belt and at the same time draw air through said openings into the tunnel along the article surfaces being heat treated and then through said belt to exhaust.

19. Apparatus for treating cup-shaped articles comprising a treatment device having an inlet and outlet and containing moving article transporting apertured belt means and associated suction means disposed for acting through said belt means for holding said articles in inverted position on said belt means to transport said articles in a predetermined direction between said inlet and an outlet of said treatment device and means for treating the moving articles, in combination with means for feeding a succession of articles into said treatment device at said inlet in such predetermined orientation that said articles are transferred to said belt means while moving laterally at substantially the same speed and in the same direction of movement as said belt means and enter said treatment device with their open ends facing said belt means.

20. Apparatus as defined in claim 19, said belt means comprising a continuously driven endless belt running within said treatment device between said inlet and outlet and having suction openings distributed along its entire length.

21. Apparatus as defined in claim 19, wherein said belt means comprises a pair of driven endless belts arranged side by side with a predetermined space between them to provide a suction aperture.

22. Apparatus as defined in claim 21 wherein said belts are driven continuously and means is provided for controlling the speed and/or direction of movement of one belt independently of the other belt.

23. Apparatus as defined in claim 19 wherein said feeding device comprises means defining an arcuate open ended channel having its outlet end operatively connected to said treatment device, and means for moving articles along said channel towards said outlet end in such orientation as to enter said treatment device in alignment with the moving belt means.

* * * * *